US008998528B2

(12) United States Patent
Boca et al.

(10) Patent No.: US 8,998,528 B2
(45) Date of Patent: Apr. 7, 2015

(54) STREET IRONWORK

(75) Inventors: Jacky Boca, Dieulouard (FR); Yvan Morcel, Viterne (FR)

(73) Assignee: Saint-Gobain Pam, Nancy (FR)

( * ) Notice: Subject to any disclaimer, the term of this patent is extended or adjusted under 35 U.S.C. 154(b) by 0 days.

(21) Appl. No.: 14/126,822

(22) PCT Filed: Jun. 13, 2012

(86) PCT No.: PCT/EP2012/061205
§ 371 (c)(1),
(2), (4) Date: Dec. 27, 2013

(87) PCT Pub. No.: WO2012/171960
PCT Pub. Date: Dec. 20, 2012

(65) Prior Publication Data

US 2014/0123560 A1 May 8, 2014

(30) Foreign Application Priority Data

Jun. 16, 2011 (FR) ..... 11 55263

(51) Int. Cl.
*E02D 29/00* (2006.01)
*E02D 29/14* (2006.01)

(52) U.S. Cl.
CPC ..... *E02D 29/1427* (2013.01); *E02D 29/14* (2013.01); *E02D 29/1463* (2013.01)

(58) Field of Classification Search
CPC ..... E02D 29/1427; E02D 29/1463
USPC ..... 404/25, 26; 52/19, 20
See application file for complete search history.

(56) References Cited

U.S. PATENT DOCUMENTS

| | | | | |
|---|---|---|---|---|
| 3,455,059 | A * | 7/1969 | Evans | 49/397 |
| 6,595,716 | B1 * | 7/2003 | VanDeVyvere et al. | 404/26 |
| 6,749,363 | B1 * | 6/2004 | Petersen | 404/25 |
| 6,951,318 | B1 * | 10/2005 | Petersen et al. | 244/114 R |
| 7,908,710 | B2 * | 3/2011 | Monneret et al. | 16/260 |
| 8,192,110 | B1 * | 6/2012 | Bryant et al. | 405/40 |
| 2005/0175409 | A1 * | 8/2005 | Hauer et al. | 404/25 |
| 2006/0245829 | A1 * | 11/2006 | Akkala et al. | 404/25 |
| 2008/0098662 | A1 * | 5/2008 | Laffitte Figueras | 52/20 |
| 2010/0178105 | A1 * | 7/2010 | Monneret | 404/25 |
| 2013/0071183 | A1 * | 3/2013 | Vrondran et al. | 404/25 |

FOREIGN PATENT DOCUMENTS

| | | |
|---|---|---|
| DE | 103 57 542 A1 | 7/2005 |
| EP | 1 091 046 A1 | 4/2001 |
| EP | 1 239 086 A1 | 9/2002 |

OTHER PUBLICATIONS

International Search Report re Application No. PCT/EP2012/061205, dated Sep. 24, 2012.

* cited by examiner

*Primary Examiner* — Raymond W Addie
(74) *Attorney, Agent, or Firm* — Knobbe Martens Olson & Bear LLP

(57) ABSTRACT

The street ironwork according to the invention includes a frame (4), a manhole cover (6), a hinge (10) for pivotably connecting the covering element relative to the frame between a closed position and an open position, the hinge including a frame knuckle (20) and a covering element knuckle (22).

The street ironwork includes a locking element (40) attached to the covering element knuckle and suitable for preventing the covering element knuckle from being released from the frame knuckle in at least one of the open positions of the covering element relative to the frame or in the closed position.

10 Claims, 9 Drawing Sheets

STREET IRONWORK

CROSS-REFERENCE TO RELATED APPLICATIONS

This application is a U.S. National Phase of International Application No. PCT/EP2012/061205, filed Jun. 13, 2012, designating the U.S., and published in French as WO 2012/171960 on Dec. 20, 2012, which claims the benefit of French Patent Application No. 1155263 filed Jun. 16, 2011.

FIELD OF THE INVENTION

The present invention relates to a street ironwork, including:

a frame, a covering element, a hinge for pivotably connecting the covering element relative to the frame between a closed position and an open position, the hinge including a frame knuckle and a covering element knuckle.

DESCRIPTION OF RELATED ART INCLUDING INFORMATION DISCLOSED UNDER 37 CFR 1.97 AND 1.98

Such street ironwork devices are known. The frame knuckle and the covering element knuckle have a shape such that the covering element knuckle and the frame knuckle can be assembled through a radial relative movement with respect to an axis specific to each of the knuckles.

However, these hinges allow the frame and the covering element to be disassembled by unauthorized persons, or allow the covering element to be stolen.

The present invention aims to propose a street ironwork that has increased security, with simple and cost-effective means.

BRIEF SUMMARY OF THE INVENTION

To that end, the invention relates to a street ironwork of the aforementioned type, characterized in that the street ironwork includes a locking element attached to the covering element knuckle and suitable for preventing the covering element knuckle from being released from the frame knuckle in at least one of the open positions of the covering element relative to the frame or in the closed position.

According to specific embodiments, the street ironwork includes one or more of the following features:

the locking device is suitable for preventing the covering element knuckle from being released from the frame knuckle in a range of positions of the covering element relative to the frame corresponding to an angular range of assembly positions of the covering element with the frame, said range of positions in particular being comprised between approximately 80° and 100 °;

the locking element is suitable for preventing the covering element knuckle from being released from the frame knuckle at least in the 90° open position;

the frame knuckle comprises additional locking means, which cooperate with the covering element knuckle in the angular positions situated outside the angular range of assembly positions and that cooperate with the locking element in the angular range of assembly positions;

the locking element is inserted into an opening of the covering element knuckle and the locking element defines an insertion direction into the opening of the covering element knuckle;

the locking element is inserted into the opening of the covering element knuckle adjusted tightly;

the locking element and the covering element knuckle have a stop opposing movement of the locking element in the insertion direction;

the locking element has a head, and the head of the locking element has no undercut in the direction opposite the insertion direction;

the head is in the shape of a cone or truncated cone;

the locking element has a shape of revolution around a locking element axis (AEB).

The invention in particular applies to manhole covers or sidewalk covers whereof the frame is covered by a cover forming the covering element, as well as manholes whereof the covering element is a grate intended to absorb surface water.

BRIEF DESCRIPTION OF THE SEVERAL VIEWS OF THE DRAWINGS

The invention will be better understood upon reading the following description, provided solely as an example and done in reference to the appended drawings, in which.

DETAILED DESCRIPTION OF THE INVENTION

Figure 1:
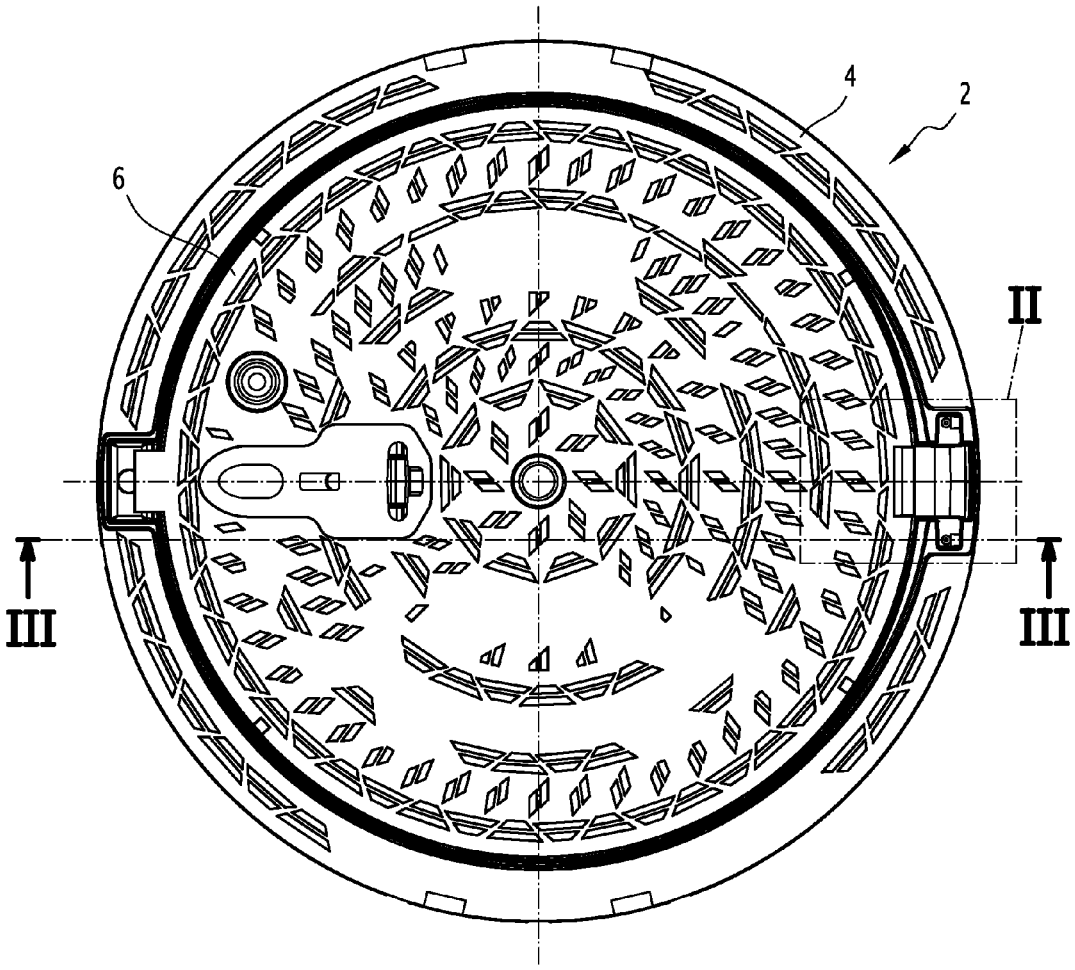
FIG. 1 is a planar view of the street ironwork according to the invention.
Figure 2:
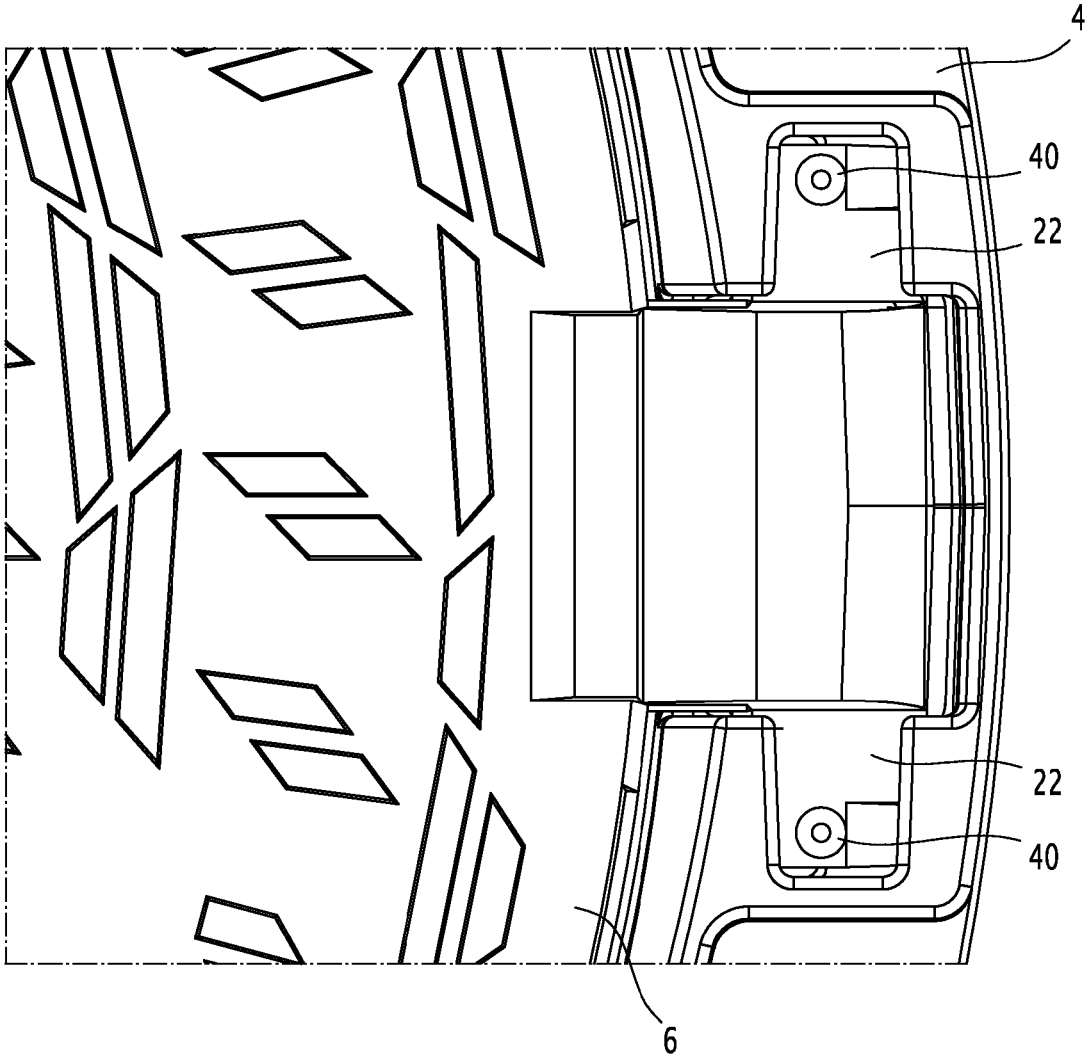
FIG. 2 is an enlarged view of detail II of FIG. 1.

The figures show a street ironwork according to the invention, designated by general reference 2.

The street ironwork 2 comprises a frame 4, a covering element formed by a manhole cover 6, and a soundproofing seal 8. The street ironwork 2 comprises a hinge 10 pivotably connecting the manhole cover 6 relative to the frame 4.

The frame 4 defines a central access opening 12 and comprises an inner rim 14 on which the soundproofing seal 8 is positioned. The frame 4 defines an upper surface 16 surrounding the central access opening 12 extending in a frame plane PC. In the installed state, the frame plane PC is substantially parallel to the ground and is preferably aligned with the surface of the ground. The frame 4 is for example made from cast iron.

The manhole cover 6 comprises a closing web 18 pressing in the closed state on the soundproofing seal 8. The closing web 18 defines a manhole cover plane PT that extends in the closed state parallel to the frame plane PC. The manhole cover 6 is for example made from cast iron.

Figure 3:
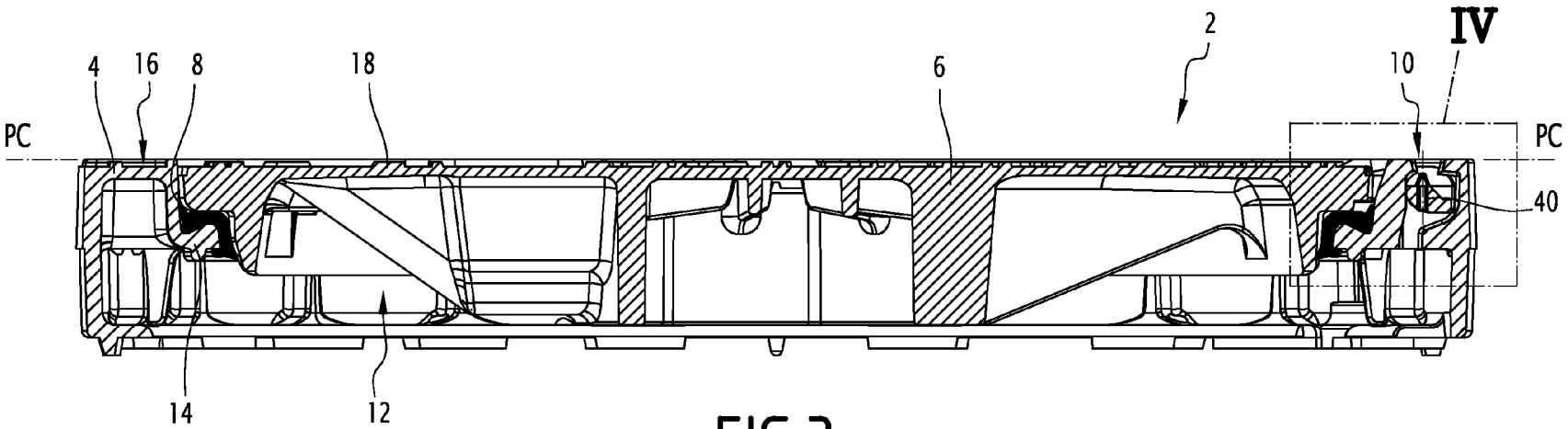
FIG. 3 is a cross-sectional view along arrow III-III of FIG. 1.
Figure 5:
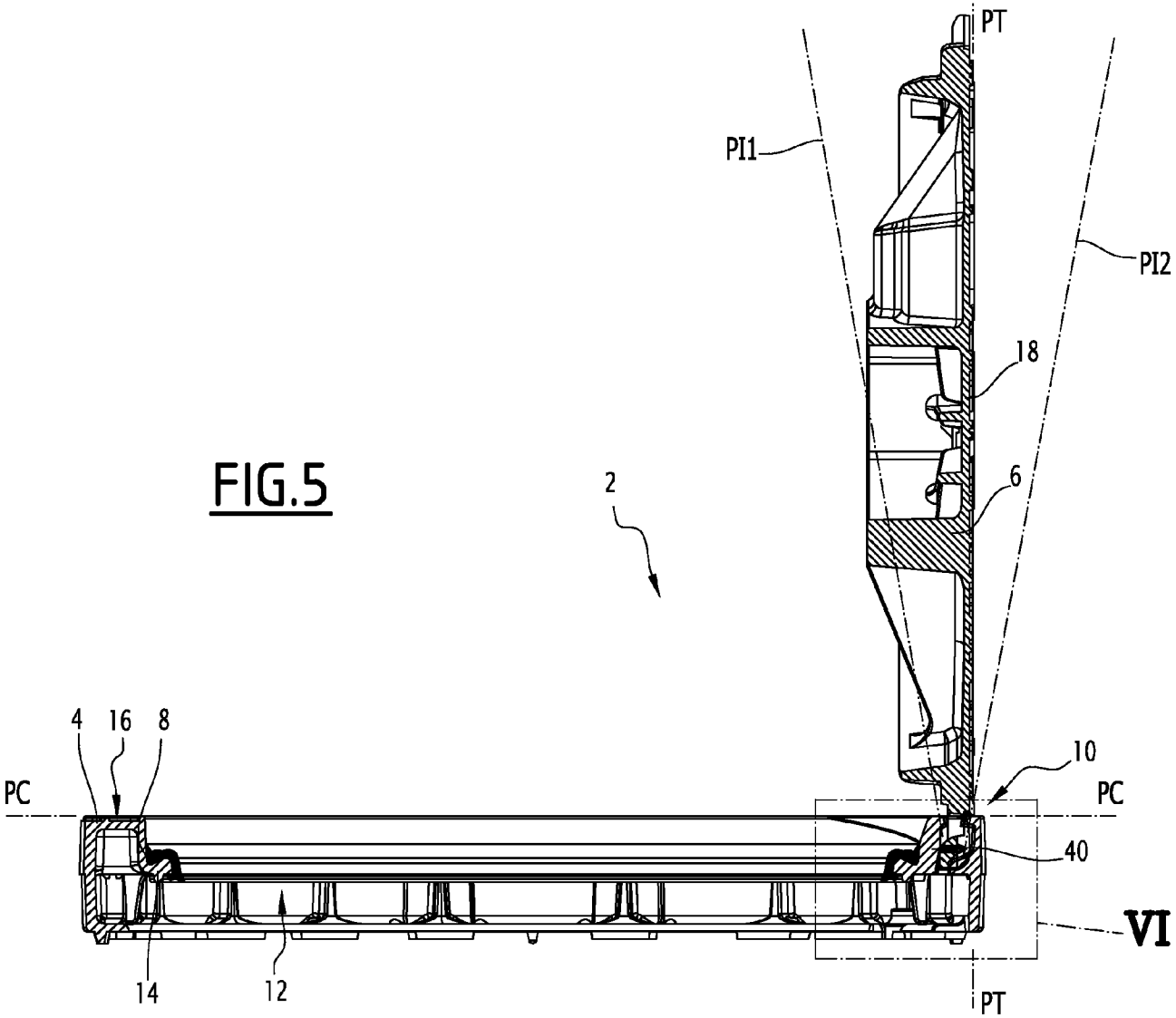
FIG. 5 is a view similar to that of FIG. 3, the cover being tilted in a 90° open position.
Figure 6:
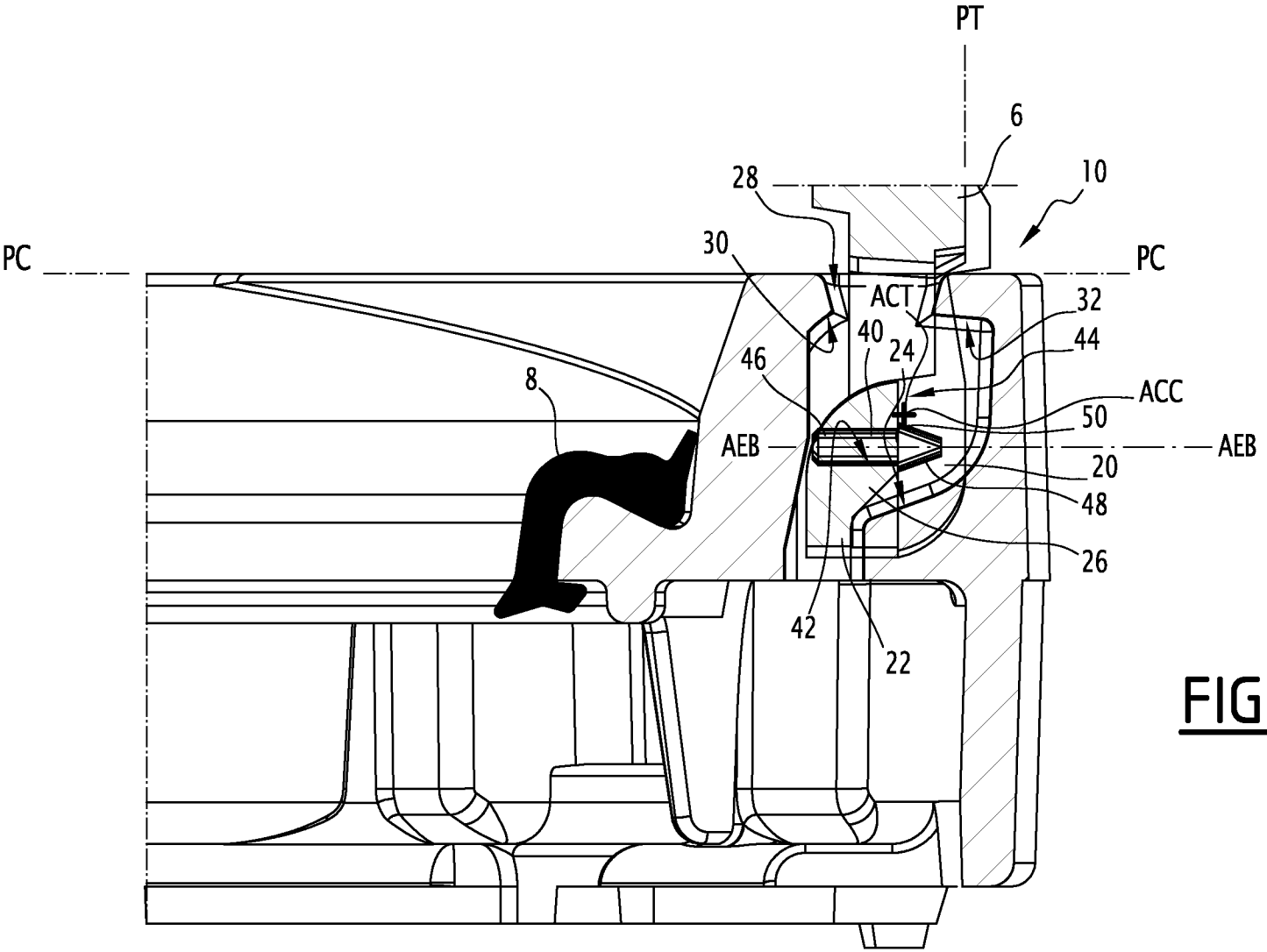
FIG. 6 is an enlarged view of detail VI in FIG. 5.
Figure 7:
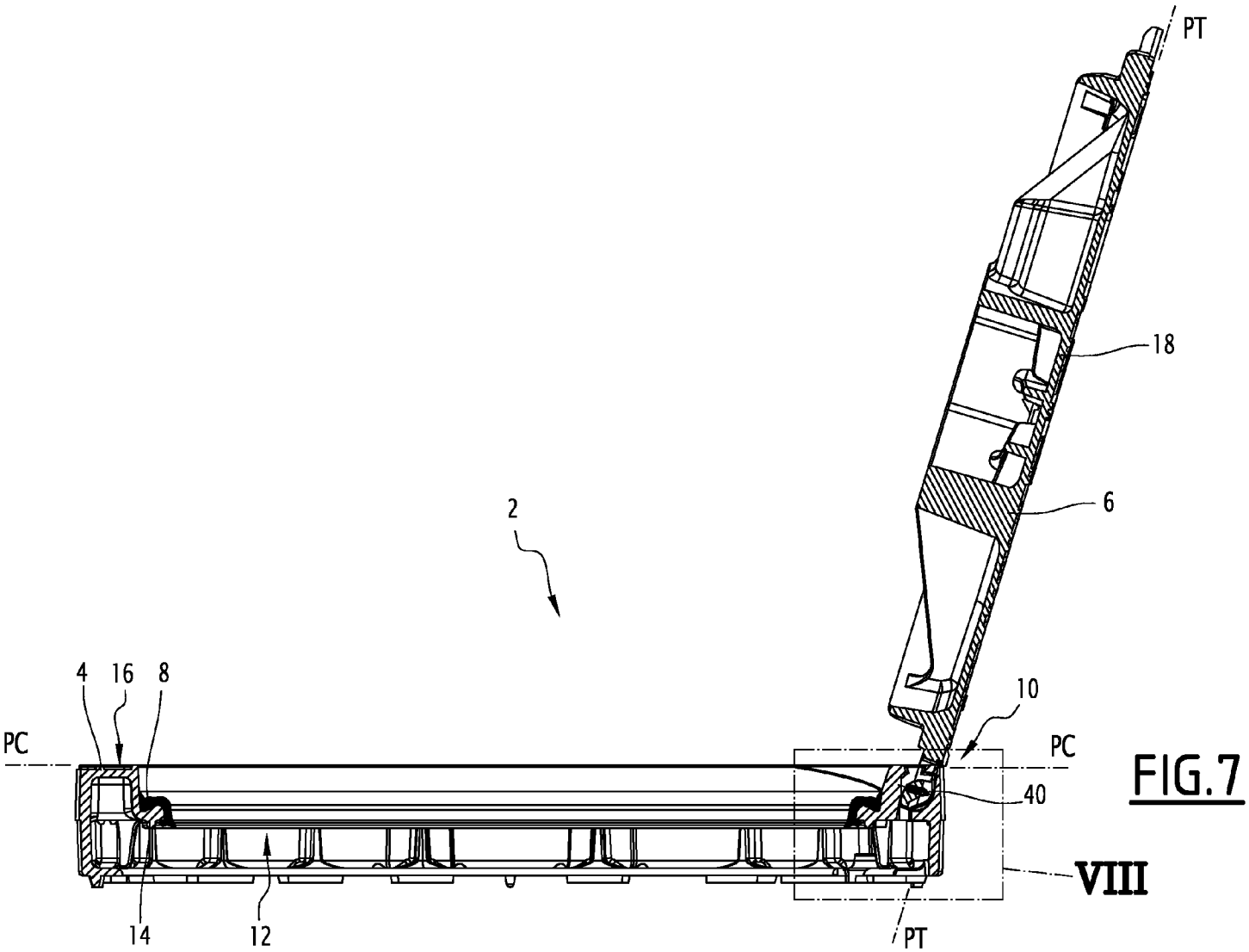
FIG. 7 is a view similar to that of FIG. 3, the cover being in a maximally open position.
Figure 8:
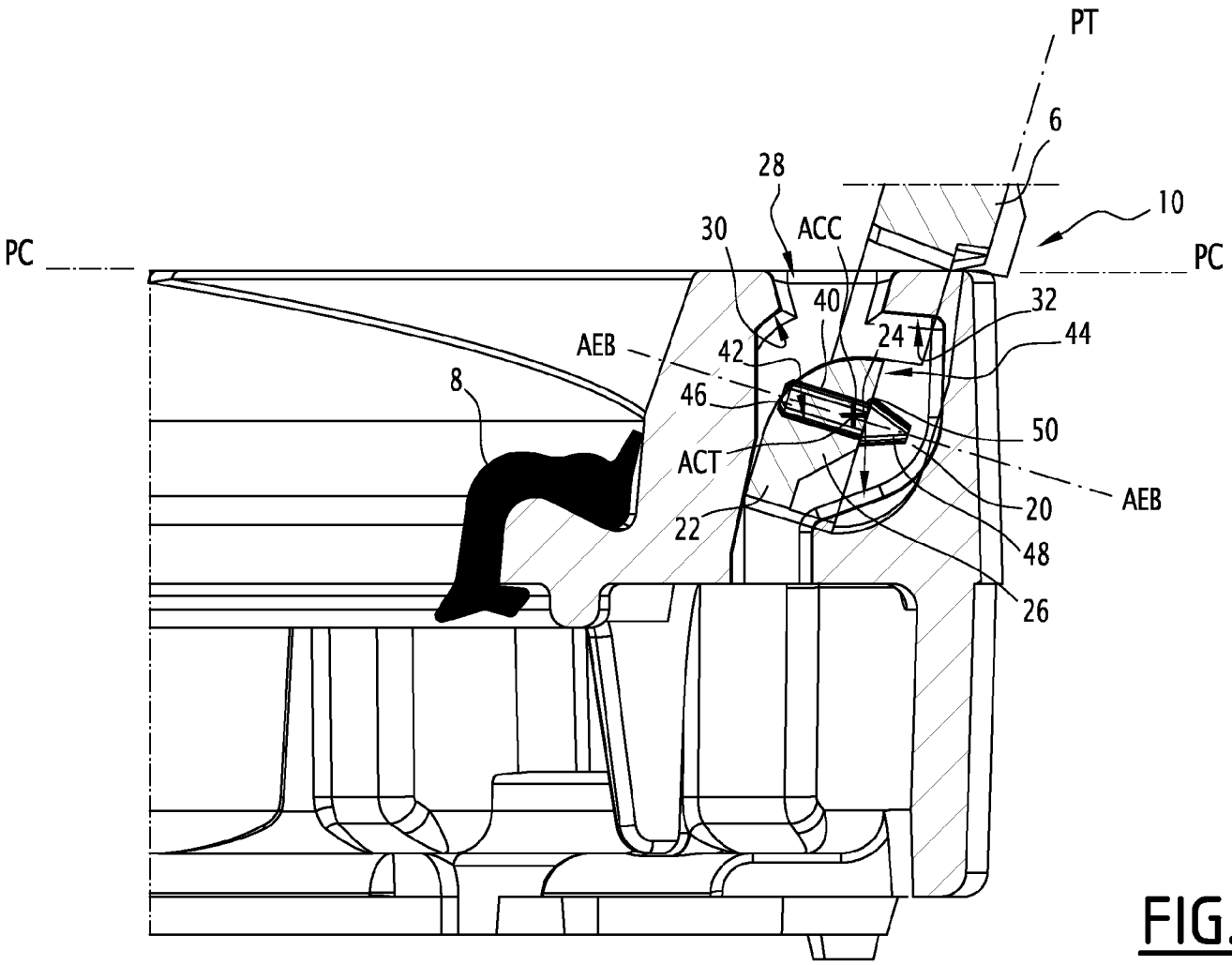
FIG. 8 is an enlarged view of detail VIII of FIG. 7.
Figure 9:
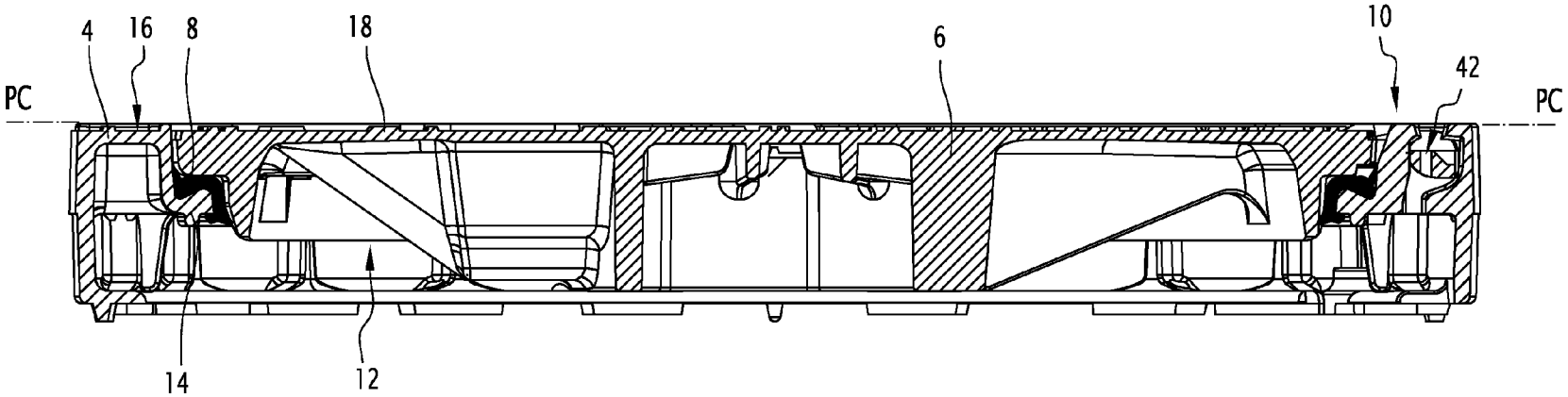
FIG. 9 is a view identical to that of FIG. 3, the locking element being omitted.

The hinge 10 pivotably connects the manhole cover 6 to the frame 4 between a closed position, shown in FIG. 3, and a 90° open position, shown in FIG. 5, as well as a maximally open position, shown in FIG. 7.

In the closed position, the manhole cover 6 covers the central access opening 12 of the frame 4. The two planes PC and PT then substantially coincide.

In the 90° open position, the manhole cover 6 no longer closes off the central access opening 12 of the frame 4 and the plane PT is positioned at a right angle relative to the plane PC.

In the maximally open position, the manhole cover 6 has tilted by more than 90° relative to the closed position. In the present case, the offset angle between the closed position and the maximally open position is approximately 110°.

The hinge 10 includes a frame knuckle 20 (see FIG. 4) and a manhole cover knuckle (22).

The frame knuckle 20 is a recess that forms a cam surface 24. The frame knuckle 20 defines a frame knuckle axis ACC. The frame knuckle 20 is formed in a single piece with the frame 4.

The manhole cover knuckle 22 is a protrusion 26 defining a manhole cover knuckle axis ACT. The manual cover knuckle 22 is formed in a single piece with the manhole cover 6 or the closing web 18.

The frame 4 comprises an assembly opening 28 emerging in the frame knuckle 20 and suitable for the passage of the manhole cover knuckle 22 during the assembly of the frame 4 and the manhole cover 6. During the assembly, the manhole cover 6 is in an assembly position in which the manhole cover plane PT forms, with the frame plane PC, an angle comprised between approximately 80° and 100°, the angle corresponding to a range of assembly positions in particular including the 90° open position. The assembly direction of the manhole cover knuckle 22 and the frame knuckle 20 is essentially radial relative to the frame knuckle axis ACC.

The frame knuckle 20 is overhung by retaining lips 30, 32 situated facing it. These lips 30, 32 delimit the assembly opening 28 and are made in a single piece with the frame 4.

The street ironwork 2 also comprises a locking element 40 attached to the manhole cover knuckle 22 after assembly of the latter with the frame knuckle 20. This locking element 40 is suitable for preventing the manhole cover knuckle 22 from being released from the frame knuckle 20 when the manhole cover is an angular position relative to the frame corresponding to an assembly position.

In the case at hand, the locking element 40 prevents the manhole cover knuckle 22 from being released from the frame 20 when the manhole cover is in an angular range corresponding to the range of assembly positions. This range of positions includes the 90° open position and is limited on the one hand by a first intermediate position PI1 in which the manhole cover 6 is open at approximately 80°, and on the other hand by a second intermediate position PI2 in which the manhole cover 6 is open by approximately 100°. These intermediate positions are shown in mixed lines in FIG. 5.

Furthermore, between the closed position and the first intermediate position PI1 and between the second intermediate position PI2 and the maximally open position, the disassembly of the manhole cover knuckle 22 from the frame knuckle 22 is prevented by the retaining lips forming locking stops 30, 32. The retaining lips 30, 32 thereby form additional locking means.

Thus, the disassembly is prevented in all of the angular positions that the manhole cover 6 may assume relative to the frame 4. This thereby results in protection against theft of the manhole cover or against removal thereof by unauthorized persons.

Figure 4:
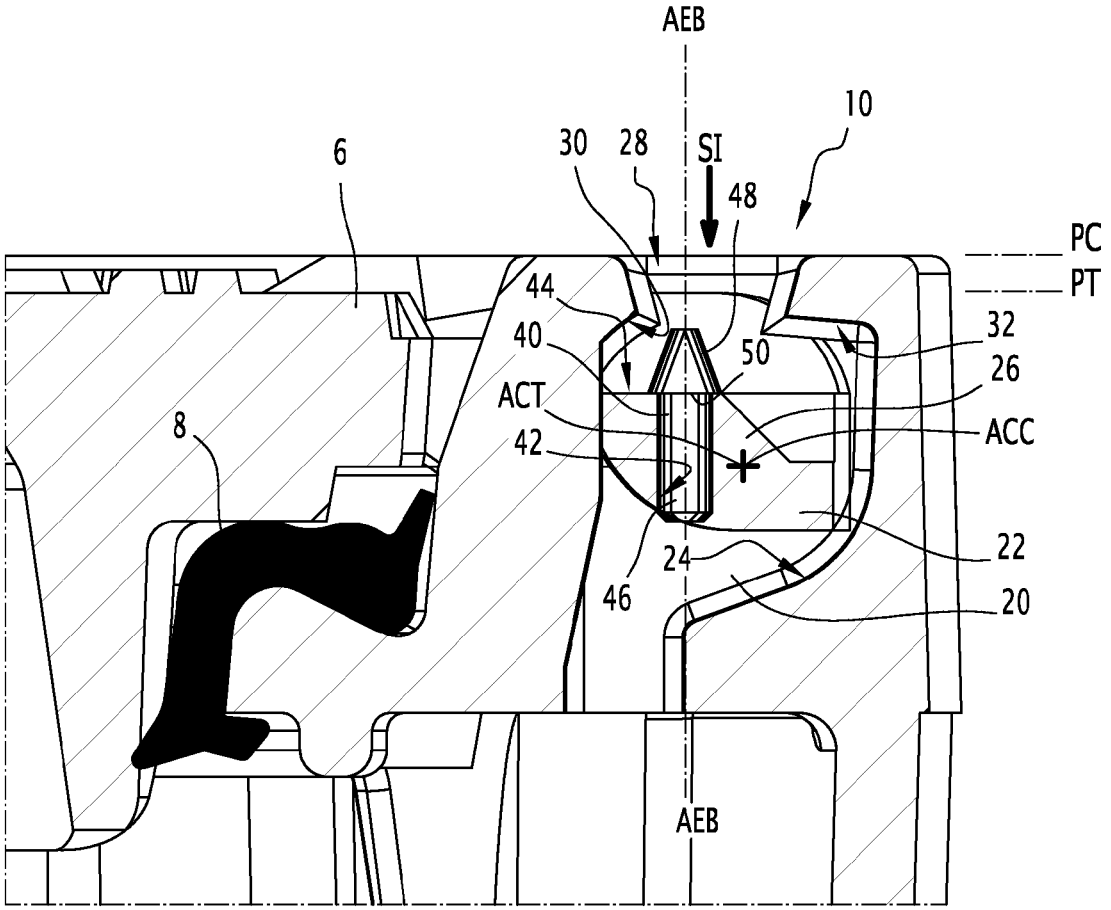
FIG. 4 is an enlarged view of detail IV of FIG. 3.

As shown in FIG. 4, the manhole cover knuckle 22 comprises an opening 42, in this case a cylindrical piercing. The manhole cover 22 comprises a surface 44 in which the opening 42 is formed. The surface 44 is planar and, in the closed state of the street ironwork 2, is positioned parallel to the frame plane PC and oriented toward the assembly opening 28 of the frame. Thus, the opening 42 may be manufactured easily by piercing.

The locking element 40 defines an insertion direction SI into the opening 42. In the present case, the insertion direction SI is oriented perpendicular relative to the manhole cover plane PT and toward the surface 44.

The locking element 40 includes a body 46 and a head 48. The locking element 40 has a shape of revolution around a locking element axis AEB. The body 46 is cylindrical with a circular section. The head 48 is in the shape of a truncated cone, or is optionally cone-shaped. The locking element 40 is thus easy to manufacture.

The dimension of the head 48 is such that the head abuts against a retaining lip 32 of the frame upon any attempt to remove the manhole cover knuckle 22 from a position of the manhole cover comprised in the angular range of assembly positions.

The locking element 40 and the manhole cover knuckle 22 also have a stop opposing the movement of the locking element in the insertion direction SI. In the present case, this stop is formed by the surface 44 and by a shoulder 50 delimited by the head 48 and the body 46.

Preferably, the body 46 of the locking element 40 is inserted into the opening 42 adjusted tightly, the locking element 40 for example forming a rivet pushed into the opening 42. Additionally, glue may be positioned between the body 46 and the opening 42.

Furthermore, the head 48 has no undercut in the direction opposite the insertion direction SI. Thus, the head 48 is difficult to grasp with a tool during any attempt to remove the locking element 40 from the opening 42. In the present case, this is obtained by the truncated cone shape of the head 48 narrowing in the direction opposite the insertion direction.

Alternatively, other shapes may be considered for the head, such as a hemisphere.

The street ironwork is manufactured as follows.

First, the frame 4 and the manhole cover 6 are manufactured, and the manhole cover knuckle 22 is inserted into the frame knuckle 20 in the assembled position.

Next, the manhole cover is brought into the closed position.

Then, the opening 42 is formed in the manhole cover knuckle 22.

Next, the locking element 40 is forcibly inserted into the opening 42 until the shoulder 50 touches the surface 44.

The described locking element 40 has the following advantages:

It makes the manhole cover difficult to steal.

It allows the street ironwork to preserve its functionalities, in particular regarding the pivoting connection of the manhole cover relative to the frame between the closed and maximally open positions, as well as the possibility of locking the manhole cover in the 90° open position so that it cannot accidentally close from that security position.

It takes little time to place.

It may be placed on new manholes as well as old manholes, but always after sealing of the frame.

Advantageously, the street ironwork according to the invention includes two locking devices 40 positioned symmetrically relative to a median plane perpendicular to the manhole cover knuckle axis.

The invention claimed is:

1. A street ironwork, including:

a frame, a covering element, a hinge for pivotably connecting the covering element relative to the frame between a closed position and an open position, the hinge including a frame knuckle and a covering element knuckle, wherein the street ironwork includes a locking element attached to the covering element knuckle after assembly of the covering element knuckle with the frame knuckle and configured to prevent the covering element knuckle from being released from the frame knuckle in at least one of the open positions of the covering element relative to the frame or in the closed position.

2. The street ironwork according to claim 1, wherein the locking device is configured to prevent the covering element knuckle from being released from the frame knuckle in a range of positions of the covering element relative to the frame corresponding to an angular range of assembly positions of the covering element with the frame, said range of positions in particular being comprised between approximately 80° and 100°.

3. The street ironwork according to claim 2, wherein the locking element is configured to prevent the covering element knuckle from being released from the frame knuckle at least in the 90° open position.

4. The street ironwork according to claim 2, wherein the frame knuckle comprises additional locking means, which cooperate with the covering element knuckle in the angular positions situated outside the angular range of assembly positions and that cooperate with the locking element in the angular range of assembly positions.

5. The street ironwork according to claim 1, wherein the locking element is inserted into an opening of the covering element knuckle and the locking element defines an insertion direction into the opening of the covering element knuckle.

6. The street ironwork according to claim 5, wherein the locking element is inserted into the opening of the covering element knuckle with a tight adjustment.

7. The street ironwork according to claim 5, wherein the locking element and the covering element knuckle have a stop opposing movement of the locking element in the insertion direction.

8. The street ironwork according to claim 5 wherein the locking element has a head, and the head of the locking element has no undercut in the direction opposite the insertion direction.

9. The street ironwork according to claim 8, wherein the head is in the shape of a cone or truncated cone.

10. The street ironwork according to claim 1, wherein the locking element has a shape of revolution around a locking element axis.

* * * * *

UNITED STATES PATENT AND TRADEMARK OFFICE

CERTIFICATE OF CORRECTION

PATENT NO. : 8,998,528 B2
APPLICATION NO. : 14/126822
DATED : April 7, 2015
INVENTOR(S) : Jacky Boca It is certified that error appears in the above-identified patent and that said Letters Patent is hereby corrected as shown below:

In the Claims

In column 6 at line 18 (approx.), In Claim 8, change “claim 5” to --claim 5,--.

Signed and Sealed this
Fifth Day of January, 2016

Michelle K. Lee

Michelle K. Lee
*Director of the United States Patent and Trademark Office*